US010689797B2

(12) United States Patent
Onizuka et al.

(10) Patent No.: US 10,689,797 B2
(45) Date of Patent: Jun. 23, 2020

(54) METHOD FOR MANUFACTURING COMPOSITE FABRIC, COMPOSITE FABRIC, AND CARBON FIBER REINFORCED MOLDING

(71) Applicant: NITTA CORPORATION, Osaka-shi, Osaka (JP)

(72) Inventors: Maki Onizuka, Osaka (JP); Takuji Komukai, Osaka (JP)

(73) Assignee: NITTA CORPORATION, Osaki-shi (JP)

( * ) Notice: Subject to any disclaimer, the term of this patent is extended or adjusted under 35 U.S.C. 154(b) by 77 days.

(21) Appl. No.: 16/079,257

(22) PCT Filed: Mar. 22, 2017

(86) PCT No.: PCT/JP2017/011336

§ 371 (c)(1),
(2) Date: Aug. 23, 2018

(87) PCT Pub. No.: WO2017/164206

PCT Pub. Date: Sep. 28, 2017

(65) Prior Publication Data

US 2019/0048519 A1 Feb. 14, 2019

(30) Foreign Application Priority Data

Mar. 25, 2016 (JP) ..... 2016-062113

(51) Int. Cl.

| | |
|---|---|
| ***D06M 11/74*** | (2006.01) |
| ***D03D 1/00*** | (2006.01) |
| ***D06M 10/02*** | (2006.01) |
| ***D03D 15/12*** | (2006.01) |
| ***D03D 13/00*** | (2006.01) |
| ***D02G 3/44*** | (2006.01) |
| *D06M 101/40* | (2006.01) |

(52) U.S. Cl.

CPC ..... *D06M 11/74* (2013.01); *D02G 3/443* (2013.01); *D03D 1/00* (2013.01); *D03D 13/004* (2013.01); *D03D 15/12* (2013.01); *D06M 10/02* (2013.01); *D06M 2101/40* (2013.01); *D10B 2331/04* (2013.01)

(58) Field of Classification Search

CPC .. D06M 11/24; D06M 10/02; D06M 2101/40; D03D 1/00; D03D 15/12; D03D 13/004; D02G 3/443; D10B 2331/04

See application file for complete search history.

(56) References Cited

U.S. PATENT DOCUMENTS

| | | | | |
|---|---|---|---|---|
| 7,867,468 | B1 * | 1/2011 | Haddon | B82Y 30/00 423/447.1 |
| 2009/0176112 | A1 | 7/2009 | Kruckenberg et al. | |
| 2010/0178825 | A1 | 7/2010 | Shah et al. | |
| 2014/0151111 | A1 * | 6/2014 | Shah | H05K 9/009 174/388 |

FOREIGN PATENT DOCUMENTS

| | | | | |
|---|---|---|---|---|
| CN | 104327454 | A | 2/2015 | |
| JP | 2006-274211 | A | 10/2006 | |
| JP | 2006274211 | * | 10/2006 | C08J 5/24 |
| JP | 2007-126311 | A | 5/2007 | |
| JP | 2009-535530 | A | 10/2009 | |
| JP | 2013-509503 | A | 3/2013 | |
| JP | 2013-076198 | A | 4/2013 | |

OTHER PUBLICATIONS

Nov. 6, 2019 extended Search Report issued in European Patent Application No. 17770246.1.

Apr. 18, 2017 Search Report issued in International Patent Application No. PCT/JP2017/011336.

* cited by examiner

*Primary Examiner* — Amina S Khan

(74) *Attorney, Agent, or Firm* — Oliff PLC

(57) ABSTRACT

Provided are a method for manufacturing a composite fabric capable of further improving the strength of a carbon fiber-reinforced molded article, a composite fabric, and a carbon fiber-reinforced molded article.

The method includes a step of holding a surface of a filter part (22A), through which a dispersion solvent and carbon nanotubes dispersed in the dispersion solvent are allowed to pass, in contact with at least one surface of a woven fabric (12A) including a carbon fiber bundle as weaving yarn, a step of immersing the woven fabric (12A) on which the filter part (22A) is held in a dispersion that comprises the dispersion solvent and the dispersed carbon nanotubes and applying ultrasonic vibrations to the dispersion, and a step of extracting the woven fabric (12A) on which the filter part (22A) is held from the dispersion and removing the filter part (22A) from the woven fabric (12A).

4 Claims, 8 Drawing Sheets

METHOD FOR MANUFACTURING COMPOSITE FABRIC, COMPOSITE FABRIC, AND CARBON FIBER REINFORCED MOLDING

TECHNICAL FIELD

The present invention relates to a method for manufacturing a composite fabric, a composite fabric, and a carbon fiber-reinforced molded article, and particularly applies to a fabric including carbon fiber bundles as weaving yarn.

BACKGROUND ART

There have been suggested CNT/carbon fiber composite materials that have a structure in which a plurality of carbon nanotubes (hereinafter, referred to as CNTs) are entangled to form a CNT network thin film on the surface of the carbon fibers as composite materials (for example, Patent Literature 1). Patent Literature 1 discloses that immersion of a carbon fiber bundle in a dispersion in which CNTs are isolatedly dispersed followed by application of energy by, for example, vibrations, light irradiation, and heat, to the isolation dispersion enables a CNT network structure to be formed on the surface of the carbon fibers.

CITATION LIST

Patent Literature

Patent Literature 1: Japanese Patent Laid-Open No. 2013-76198

SUMMARY OF INVENTION

Technical Problem

Unfortunately, even when, as a composite material, a composite fabric that includes a woven fabric including carbon fibers as weaving yarn and a CNT network structure formed on the surface of the woven fabric is manufactured in the same manner as in Patent Literature 1, in other words, the woven fabric is immersed in a dispersion in which CNTs are isolatedly dispersed, and energy such as vibrations is applied to the isolation dispersion, there is the following problem: a large number of aggregates of the CNTs adhere to the surface of the woven fabric. There is a concern that such aggregates of CNTs are responsible for a decrease in the strength of a carbon fiber-reinforced molded article obtained by impregnating a composite fabric with a resin and additionally reduce designability.

It is an object of the present invention to provide a method for manufacturing a composite fabric capable of further improving the strength of a carbon fiber-reinforced molded article, a composite fabric, and a carbon fiber-reinforced molded article.

Solution to Problem

The method for manufacturing a composite fabric according to the present invention is characterized by including a step of holding a surface of a filter part, through which a dispersion solvent and carbon nanotubes dispersed in the dispersion solvent are allowed to pass, in contact with at least one surface of a woven fabric including a carbon fiber bundle as weaving yarn, a step of immersing the woven fabric on which the filter part is held in a dispersion that contains the dispersion solvent and the dispersed carbon nanotubes and applying ultrasonic vibrations to the dispersion, and a step of extracting the woven fabric on which the filter part is held from the dispersion and removing the filter part from the woven fabric.

The composite fabric according to the present invention is characterized in that the fabric includes a woven fabric that includes a carbon fiber bundle as weaving yarn and a structure which is formed on a surface of the woven fabric and includes a plurality of carbon nanotubes, the structure includes a network structure part in which the plurality of carbon nanotubes are connected directly to one another, and the abundance ratio of aggregation portions in which the plurality of carbon nanotubes are aggregated is 25% or less per unit area.

The carbon fiber-reinforced molded article according to the present invention is characterized by including the composite fabric described above.

Advantageous Effect of Invention

According to the present invention, it is possible to form a structure including a small number of aggregation portions of CNTs on the surface of a woven fabric, and thus to further improve the strength of a carbon fiber-reinforced molded article including the composite fabric.

DESCRIPTION OF EMBODIMENT

Hereinbelow, an embodiment of the present invention will be described in detail with reference to the drawings.

(1) Entire Configuration

Figure 1:
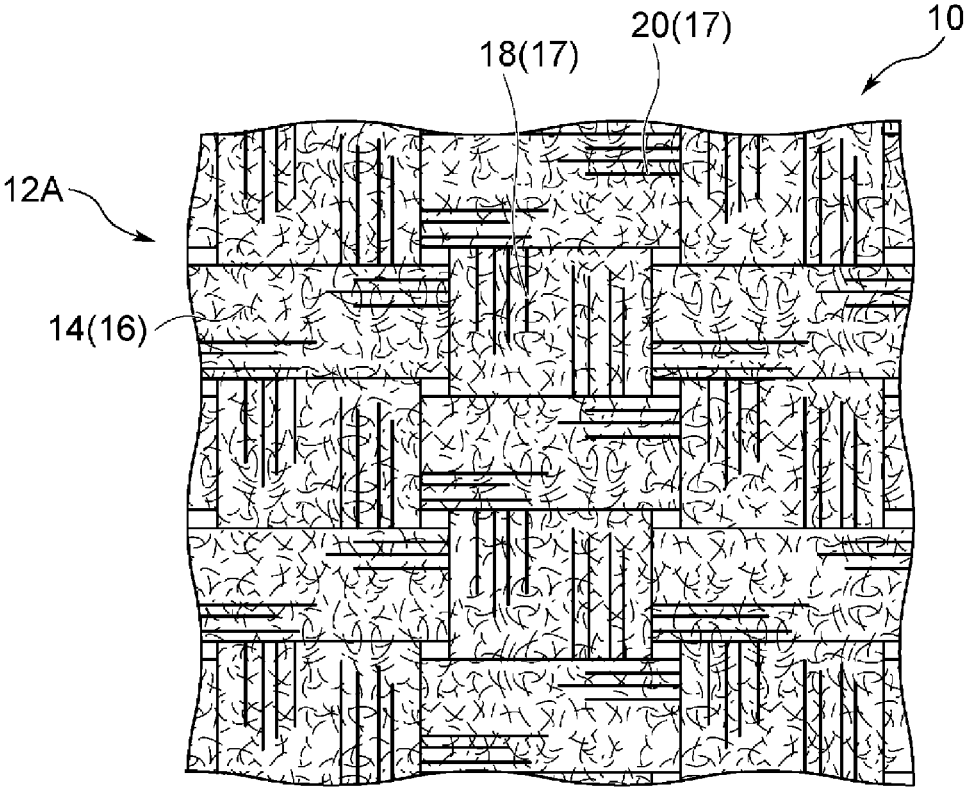
FIG. 1 is an enlarged plan view schematically showing a part of a composite fabric according to the present embodiment.

A composite fabric 10 shown in FIG. 1 includes a woven fabric 12A and a structure 14 formed on both the sides of the woven fabric 12A. The woven fabric 12A is a carbon fiber cloth including carbon fiber bundles 17 each formed by bundling a plurality of carbon fibers as weaving yarn. The woven fabric 12A shown in FIG. 1 is formed by plain-weaving the carbon fiber bundles 17 as warp 18 and weft 20. Carbon fibers are fibers having a diameter of about 5 to 20 μm obtained by firing organic fibers derived from petroleum, coal, or coal tar such as polyacrylonitrile, rayon, and pitch or organic fibers derived from wood or plant fibers.

The structure 14 includes a plurality of CNTs 16 homogeneously dispersed across the entire surface of the woven fabric 12A. The structure 14 has a network structure part in which the plurality of CNTs 16 are connected directly to one another. Direct connection as used herein refers to a state in which the CNTs 16 that are coated with no dispersing agent, surfactant, or adhesive are entangled and connected with one another without any intervening material such as an adhesive, dispersing agent, and surfactant thereamong, including physical connection (merely contact) and chemical connection.

The CNTs 16 are preferably multi-layered. The CNTs 16 also preferably have a length of 0.1 μm or more and 50 μm or less. When the CNTs 16 have a length of 0.1 μm or more, the CNTs 16 are entangled and connected directly with one another. When the CNTs 16 have a length of 50 μm or less, the CNTs 16 are more likely to be homogeneously dispersed. In contrast, when the CNTs 16 have a length of less than 0.1 μm, the CNTs 16 are less likely to be entangled. When the CNTs 16 have a length of more than 50 μm, the CNTs 16 are more likely to aggregate.

The CNTs 16 preferably have a diameter of 30 nm or less. When having a diameter of 30 nm or less, the CNTs 16 are highly flexible and deform along the curved surface of the carbon fibers. In contrast, when having a diameter of more than 30 nm, the CNTs 16 become less flexible and less likely to deform among the surface of the carbon fibers.

The CNTs 16 more preferably have a diameter of 20 nm or less. Note that the diameter of the CNTs 16 is an average diameter determined by extracting a portion of the CNTs 16 to be used for adhesion before adhesion of the CNTs 16 to carbon fibers by the method described hereinbelow and using an image obtained by photographing the CNTs 16 using a transmission electron microscope (TEM).

Such a structure 14 is fixed directly on the surface of the woven fabric 12A. In other words, the CNTs 16 along with a surface of the carbon fibers are fixed on the surface of the carbon fibers not by being coated with an adhesive, dispersing agent, or surfactant, or not via an adhesive, dispersing agent, or surfactant, but the CNTs 16 are directly fixed on the surface of the carbon fibers. The fixing as used herein includes bonding between the carbon fibers and the CNTs 16 by van der Waals force and chemical bonding between the carbon fibers and the CNTs 16 via hydroxy groups or carboxy groups formed on the surface of the CNTs 16.

The structure 14 may include aggregation portions (not shown in FIG. 1) in which a plurality of CNTs 16 are aggregated. An aggregation portion as used herein refers to a state in which two or more of the CNTs 16 are physically entangled. In the present embodiment, the abundance ratio of aggregation portions in the woven fabric is 25% or less per unit area.

The composite fabric 10 described above can be impregnated with a thermoplastic resin as a base material and then be used in carbon fiber reinforced thermoplastic (CFRTP) materials as carbon fiber-reinforced molded articles

(2) Manufacturing Method

Subsequently, the method for manufacturing the composite fabric 10 according to the present embodiment will be described. The composite fabric 10 can be manufactured by producing the CNTs 16, adjusting a dispersion containing the CNTs 16, and forming the structure 14 using the dispersion on a surface of the woven fabric 12A. Each of steps will be described hereinbelow in sequence.

(Production of CNTs)

The CNTs 16 can be produced by using a thermal CVD method as described in, for example, Japanese Patent Laid-Open No. 2007-126311. In this case, first, a catalytic membrane including aluminum and iron is deposited on a silicon substrate, and the catalytic membrane is thermally treated to form catalyst particles on the surface of the catalytic membrane. Then, growing the CNTs 16 from the catalyst particles by bringing a hydrocarbon gas into contact with the catalyst particles in a heating atmosphere can produce the CNTs 16.

The CNTs 16 thus produced are linearly oriented on the substrate in the direction perpendicular to the substrate surface, having an aspect ratio as high as several hundreds to several thousands. The CNTs 16 are clipped off from the substrate before use. The CNTs 16 clipped off may contain catalyst residues such as catalyst particles and chips thereof. The catalyst residues are desirably removed by high temperature-annealing in an inert gas or acid treatment of the CNTs 16 produced.

Although the CNTs 16 may be obtained by some other production method such as an arc discharge method or a laser vaporization method, it is desirable to produce the CNTs 16 by methods including no or a minimum possible amount of impurities (such as catalyst residues) other than the CNTs 16. These impurities are desirably removed in the same manner as for the catalyst residues.

(Adjustment of Dispersion)

A dispersion in which the CNTs 16 produced by the method described above are isolatedly dispersed will be adjusted. Isolation dispersion refers to a state in which the CNTs 16 dispersed in a dispersion solvent are physically separated one by one and not entangled with one another and the proportion of aggregates, in each of which two or more the CNTs 16 are aggregated in bundles, is 10% or less. The proportion of the aggregates, in which the CNTs 16 are aggregated, is determined by measuring the number of the CNTs 16 and the number of the aggregates from a TEM image.

First, the CNTs 16 produced by the method described above are oxidized in an oxygen atmosphere at a predetermined temperature. At this time, functional groups such as hydroxy groups and carboxy groups are formed on a portion of the surface of the CNTs 16. The CNTs 16 may be oxidized with an ozone treatment apparatus, and for example, the CNTs 16 may be oxidized by immersion in a mixed acid of nitric acid and sulfuric acid (the ratio may be optionally determined) or in a sulfuric acid/hydrogen peroxide in water mixture of hydrogen peroxide in water and sulfuric acid (the ratio may be optionally determined).

Next, the CNTs 16 whose surface is oxidized are added to a dispersion solvent so as to achieve the predetermined mass concentration. Then, uniformly dispersing the CNTs 16 using a homogenizer, high pressure shearing, or an ultrasonic disperser can provide a dispersion in which the CNTs are isolatedly dispersed.

Examples of the dispersion solvent that can be used include water, alcohols such as ethanol, methanol, and isopropyl alcohol, and organic solvents such as toluene, acetone, tetrahydrofuran (THF), methyl ethyl ketone (MEK), hexane, normal hexane, ethyl ether, xylene, methyl acetate, and ethyl acetate. The dispersion may contain a dispersing agent, surfactant, adhesive or the like unless the functions of the woven fabric 12A and the CNTs 16 are limited.

The dispersion preferably contains the CNTs 16 isolatedly dispersed to a certain degree even if the proportion of aggregates described above is more than 10%.

(Formation of Structure)

Figure 2:
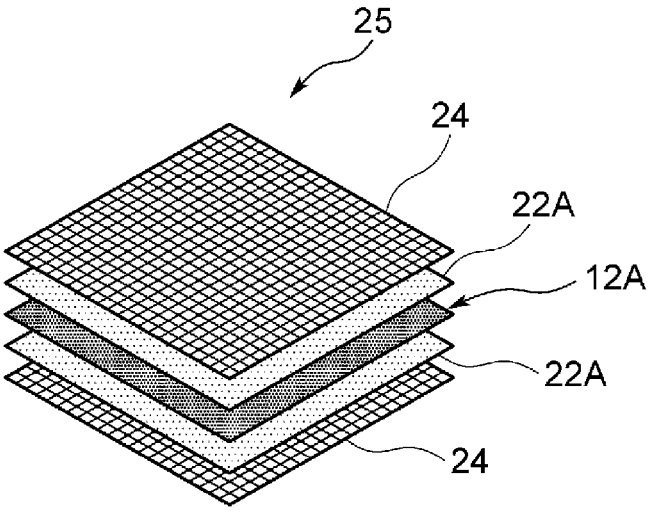
FIG. 2 is a perspective view to be used for describing a method for manufacturing a composite fabric according to the present embodiment.

As shown in FIG. 2, the woven fabric 12A, filter parts 22A, and holding parts 24 that are cut to a predetermined size are provided. The woven fabric 12A is a carbon fiber cloth, to the surface of which a sizing agent is applied. As the filter parts 22A, mesh formed from a synthetic resin can be used. The synthetic resin is only required to have resistance to the dispersion solvent, and can be selected from, for example, polypropylene, polyethylene, polyamides, and polyesters. The mesh as the filter parts 22A has an opening of preferably 840 μm or less, more preferably 41 μm or less. The opening is represented by (25.4/M−d), where M is the number of unit opening areas in a square of 1-inch (25.4 mm) warp×1-inch (25.4 mm) weft, and d is the wire diameter. As the holding parts 24, metal mesh may be used. The holding parts 24 each have an opening that allows ultrasonic waves to pass therethrough (of the order of 0.6 mm), and the center of the surface of each part protrudes curvedly in the thickness direction.

The filter part 22A and the holding part 24 are disposed in this order on both the sides of the woven fabric 12A in such a manner as to sandwich the woven fabric 12A to thereby obtain a laminate 25. The holding part 24 is disposed such that the surface protruding curvedly is in contact with the filter part 22A. Pinching the ends of the holding parts 24 with clips, not shown, allows the laminate 25 to be integrated. The pinching causes the holding part 24 to press the filter part 22A onto a surface of the woven fabric 12A. The clearance between the woven fabric 12A and the filter part 22A is preferably 100 μm or less.

Next, the laminate 25 is immersed in a resin removing agent to remove the sizing agent applied onto the surfaces of the woven fabric 12A. Examples of the resin removing agent that can be used include organic solvents such as MEK. Once the sizing agent is removed, binding among the carbon fiber bundles 17 is unbound, but the woven fabric 12A, which is fixed by the holding parts 24, is maintained in the plain weave form.

Then, the laminate 25 is immersed in a dispersion prepared as described above, and ultrasonic vibrations are applied to the dispersion. Applying ultrasonic vibrations into the dispersion causes a reversible reaction state in the dispersion, in which dispersion and aggregation states of the CNTs 16 are alternately repeated. This reversible reaction state occurs also while the laminate 25 is immersed in the dispersion. The ultrasonic vibrations pass through the holding part 24 and the filter part 22A to reach the woven fabric 12A. These ultrasonic vibrations make the CNTs 16 isolatedly dispersed pass through the holding part 24 and filter part 22A to reach the woven fabric 12A. Accordingly, the reversible reaction state including the dispersion and aggregation states of the CNTs 16 occurs also on the carbon fiber surface of the woven fabric 12A. When the CNTs 16 transfer from the dispersion state to the aggregation state, the CNTs 16 are entangled to adhere on the carbon fiber surface, and thus, the structure 14 is formed on the carbon fibers.

When the CNTs 16 are aggregated, the CNTs 16 are fixed on the surface of the carbon fibers via hydroxy groups or carboxy groups formed on the surface of the CNTs 16 or by the van der Waals force acting between the carbon fibers and the CNTs 16.

Meanwhile, aggregates contained in the dispersion cannot pass through the filter part 22A and do not reach the woven fabric 12A. Accordingly, the CNT aggregates, although adhering to the filter part 22A, are blocked by the filter part 22A and prevented from adhering to the surface of the woven fabric 12A. Since the clearance between the woven fabric 12A and the filter part 22A is maintained to 100 μm or less, no flow such as convection of the dispersion occurs on the surface of the woven fabric 12A, and the CNTs 16 are moved in the dispersion only by the ultrasonic vibrations. This prevents the CNTs 16 that have once adhered to the woven fabric 12A from falling off due to the flow of the dispersion, and thus, the amount of the CNTs 16 adhering is dramatically increased.

Subsequently, after the laminate 25 is extracted from the dispersion and washed with MEK, the clips are detached, and the filter parts 22A and the holding parts 24 are removed from the woven fabric 12A. Then, the laminate 25 is dried. Application of a sizing agent in the end can obtain the composite fabric 10 including a woven fabric 12A on which the structure 14 is formed. The structure 14 is not formed among carbon fiber bundles 17 in interstices of the woven fabric 12, in other words, areas in which the carbon fiber bundles 17 overlap because the CNTs 16 do not penetrate thereinto. After the laminate 25 is extracted from the dispersion, the clips are immediately detached, and the filter parts 22A and the holding parts 24 are removed from the woven fabric 12A, the fabric 12 may be washed with MEK.

(3) Action and Effect

The composite fabric 10 according to the present embodiment is to be produced by allowing the CNTs 16 to adhere to the surfaces of the woven fabric 12A in the dispersion by means of ultrasonic vibrations while the filter part 22A is provided on each surface of the woven fabric 12A with a clearance of 100 μm or less to thereby form the structure 14 on each surface of the woven fabric 12A. CNT aggregates adhering to the filter parts 22A, after dried on the filter parts 22A, turn into a CNT aggregation portions, which are then removed along with the filter parts 22A.

A carbon fiber-reinforced molded article including the composite fabric 10 configured as described above and a base material has an improved adhesion strength between composite fabric 10 and base material by an anchoring effect because the composite fabric 10, which has the structure 14 including the CNTs 16 on the surface thereof, has fine unevenness derived from the structure 14 on the surface.

While the CNTs 16 in the composite fabric 10 have a high elastic modulus, the base material composed of a cured product of a resin material has a lower elastic modulus. In the carbon fiber-reinforced molded article, on the interface between the woven fabric and the base material, a composite layer is formed by a portion of the base material and the CNTs 16. The composite layer intervening between the woven fabric 12A and the base material relaxes the stress concentration on the interface between the woven fabric 12A and the base material by suppressing an abrupt change in the elastic modulus, enabling the strength of the carbon fiber-reinforced molded article to be improved. Incidentally, aggregation portions contained in the structure are responsible for reducing the strength of the carbon fiber-reinforced molded article because stress concentrates in such portions.

In the composite fabric 10, a structure 14 including a small number of aggregation portions of the CNTs 16 can be formed on each surface of the woven fabric 12A. Thereby the composite fabric 10 can provide an improved strength of the carbon fiber-reinforced molded article. Accordingly, the carbon fiber-reinforced molded article in which the composite fabric 10 is employed can include a uniform composite layer, having a further improved strength. The composite fabric 10, having a small number of aggregation portions of the CNTs 16 on its surface, can improve the designability of the surface of the carbon fiber-reinforced molded article in which the composite fabric 10 is employed.

The composite fabric 10 according to Example 1 was produced in accordance with the procedure described in the above "(2) Manufacturing Method". In Example 1, multilayer carbon nanotubes grown to a diameter of 10 to 15 nm and a length of 100 μm or more on a silicon substrate by the thermal CVD method aforementioned were used as the CNTs 16.

The CNTs 16 produced were immersed in a mixed acid of nitric acid and sulfuric acid (the ratio may be optionally determined) or in a sulfuric acid/hydrogen peroxide in water mixture of hydrogen peroxide in water and sulfuric acid (the ratio may be optionally determined). After washed, the CNTs 16 were filtered and dried to remove catalyst residues. In Example 1, the CNTs 16 were not additionally subjected to oxidization treatment because the surface of the CNTs 16 was oxidized when the CNTs 16 were immersed in a mixed acid in order to remove catalyst residues.

After the CNTs 16 were added to MEK as a dispersion solvent, the CNTs 16 were uniformly dispersed while the CNTs 16 were pulverized in an ultrasonic homogenizer to a length of 0.5 to 10 μm because the CNTs 16 produced has a length as long as 100 μm or more. The concentration of the CNTs 16 in the dispersion was set to 0.025 wt %.

A carbon fiber fabric (manufactured by SAKAI OVEX Co., Ltd., model (product) number: SA-32021, size 50×50 mm) was used as the woven fabric 12A, nylon mesh (manufactured by NYTAL, model (product) number: NY41-HC, size 80×80 mm) was used as the filter part 22A, and a craft mesh screen (manufactured by Yoshida Taka K.K., model (product) number: 2004-45(T), size 70×70 mm) was used as the holding part 24. The laminate 25 was immersed in a resin removing agent to remove the sizing agent. The resin removing agent used was MEK. Next, the laminate 25 was immersed in the dispersion, and the dispersion was continuously ultrasonicated at 130 kHz for 1 minute 30 seconds. Thereafter, the laminate 25 was extracted from the dispersion and washed with MEK, and then, the filter parts 22A and the holding parts 24 were removed. The woven fabric 12A was dried on a hot plate at 80° C. In the end, a sizing agent was applied, and then, the composite fabric 10 was obtained. As a comparison, a composite fabric 10 according to Comparative Example 1 was produced under the same conditions as in Example 1 except that no filter part 22A and holding part 24 were used.

Figure 3B:
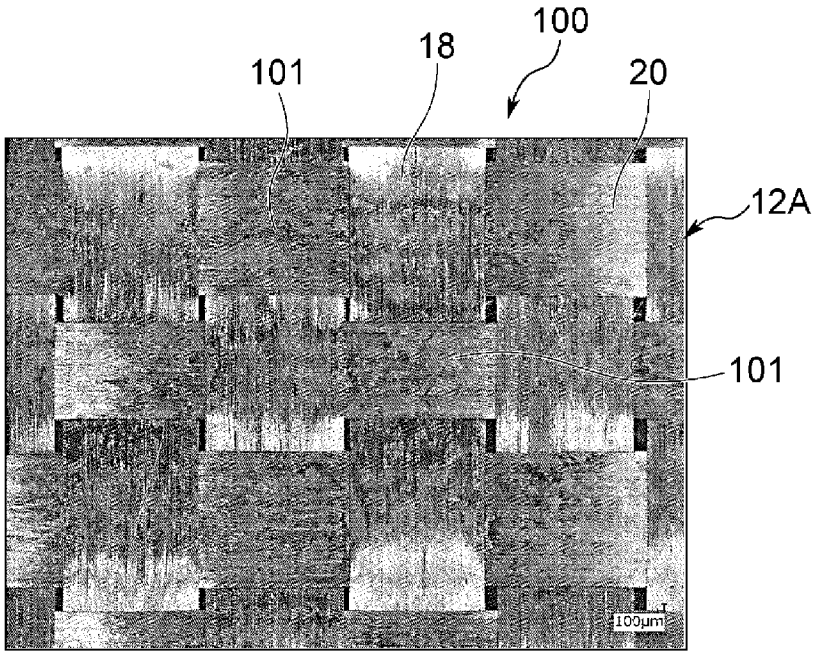
FIG. 3B is an enlarged view of a composite fabric according to Comparative Example 1.
Figure 3A:
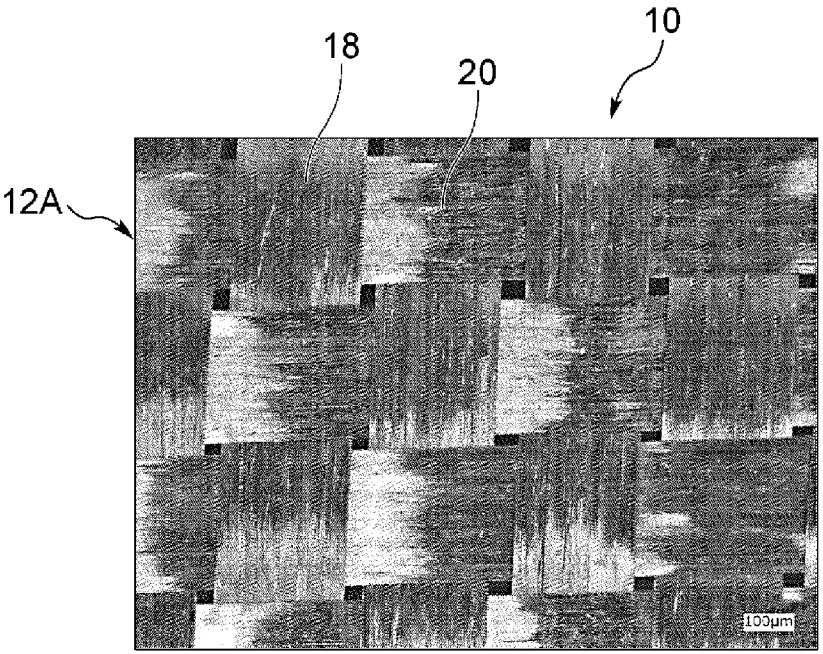
FIG. 3A is an enlarged view of a composite fabric according to Example 1.

As shown in FIG. 3A, in the composite fabric 10 of Example 1, substantially no aggregation portion was observed on the surfaces of the woven fabric 12A. In contrast, as shown in FIG. 3B, in the composite fabric 100 of Comparative Example 1, a plurality of island-shaped aggregation portions 101 were observed on the surfaces of the woven fabric 12A.

Figure 4B:
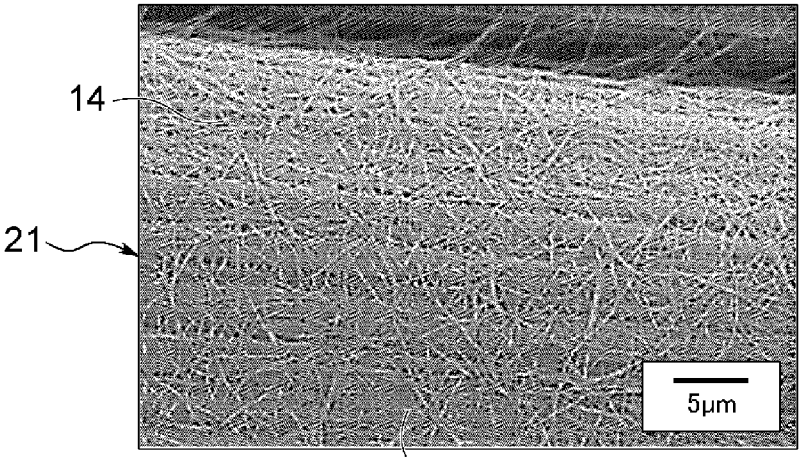
FIG. 4B is a scanning electron microscope (SEM) image of the composite fabric according to Example 1, which is an enlarged view of a carbon fiber.
Figure 4A:
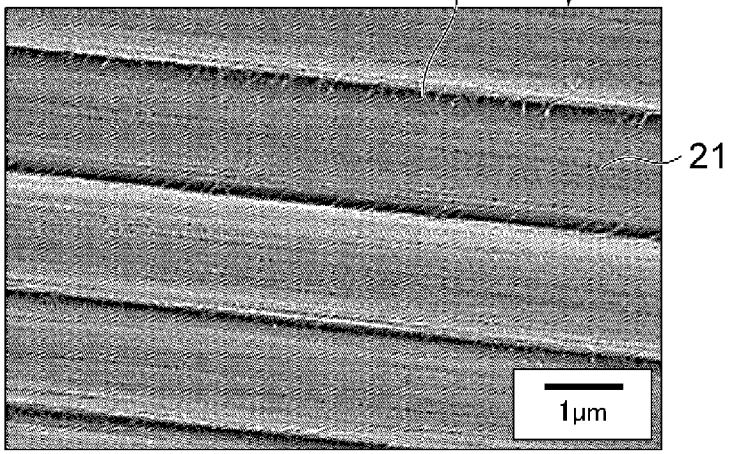
FIG. 4A is a scanning electron microscope (SEM) image of the composite fabric according to Example 1, which is an enlarged view of a carbon fiber bundle.

In the composite fabric 10 of Example 1, as shown in FIGS. 4A and 4B, it was observed that the CNTs 16*s* adhered uniformly to the surface of the carbon fibers 21 and the carbon fibers 21 constituting the carbon fiber bundle 17 were connected to one another via the CNTs 16.

Figure 5C:
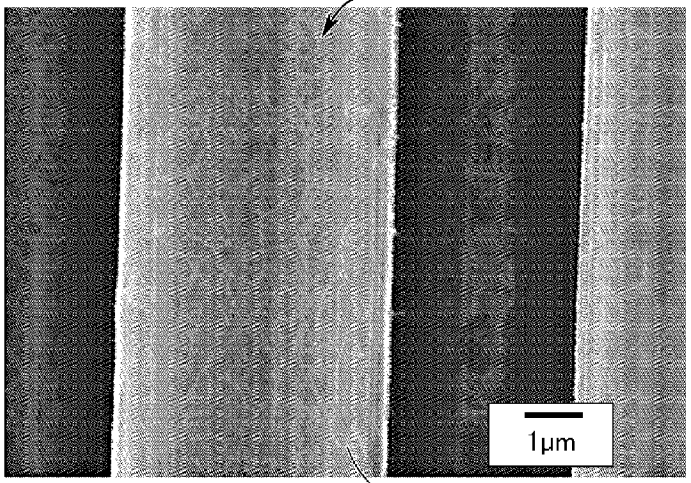
FIG. 5C is an SEM image of a carbon fiber bundle, which view is used for describing Example 2.
Figure 5A:
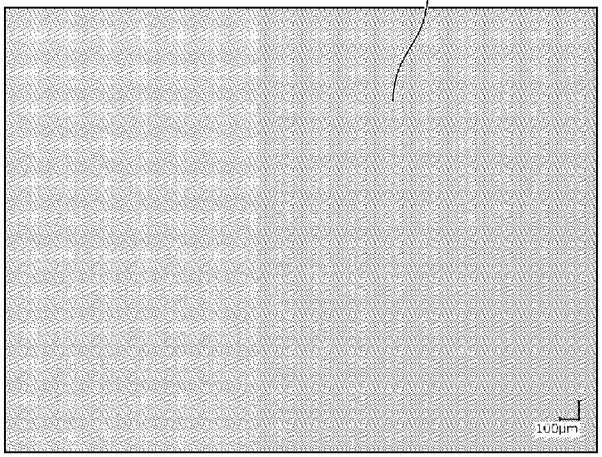
FIG. 5A is an enlarged view of a dispersion in which CNTs are isolatedly dispersed, which view is used for describing Example 2.
Figure 5B:
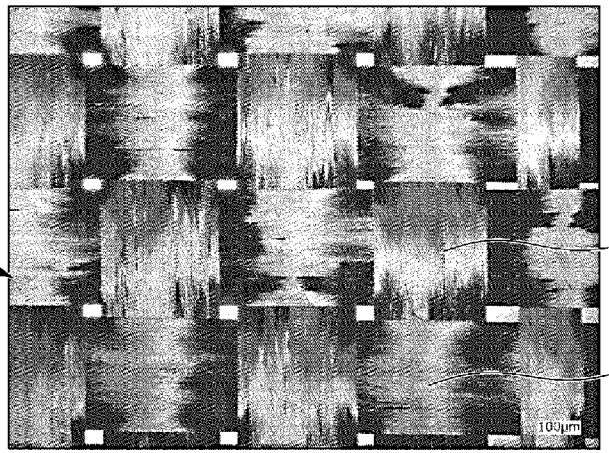
FIG. 5B is an enlarged view of a composite fabric, which view is used for describing Example 2.
Figure 6A:
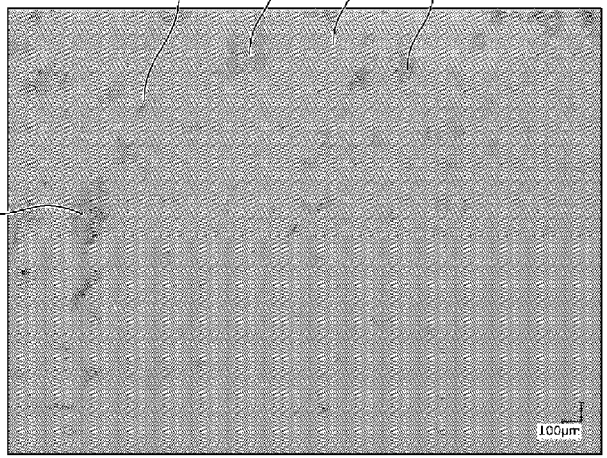
FIG. 6A is an enlarged view of a dispersion in which aggregates of CNTs are mixedly present, which view is used for describing Example 3.
Figure 6B:
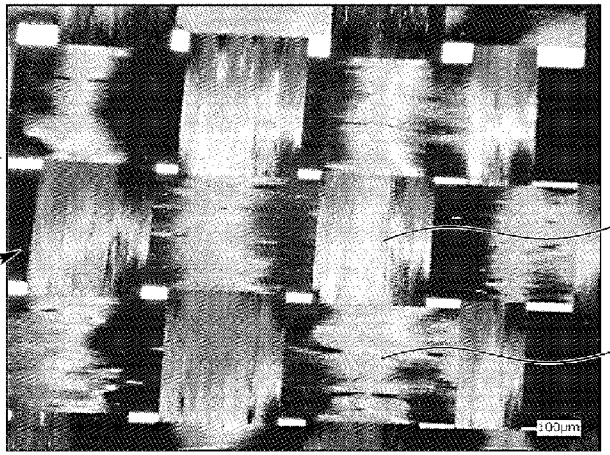
FIG. 6B is an enlarged view of a composite fabric, which view is used for describing Example 3.
Figure 6C:
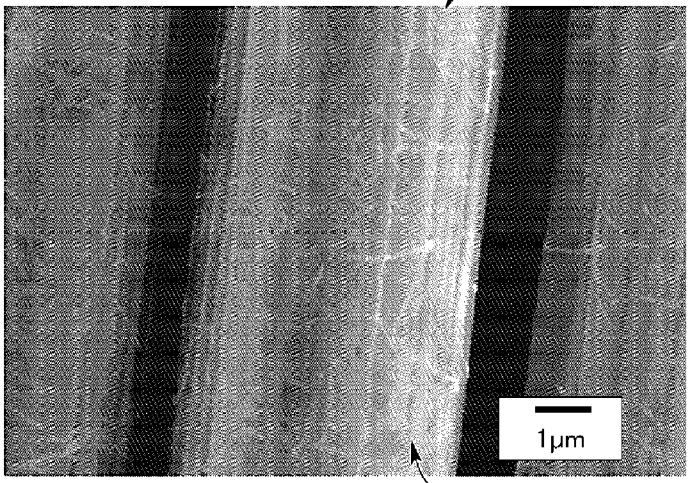
FIG. 6C is an SEM image of a carbon fiber bundle, which view is used for describing Example 3.

Next, investigation was made on a difference between structures 14 to be formed with different dispersions on the surfaces of the woven fabric 12A. A composite fabric 10 according to Example 2 was produced under the same conditions as in Example 1. A composite fabric 10 according to Example 2 was produced under the same conditions as in Example 1 except that the solvent for the dispersion was replaced by ethanol. The results of Example 2 are shown in FIGS. 5A to 5C and the results of Example 3 are shown in FIGS. 6A to 6C. In a dispersion 26 used in Example 2, as shown in FIG. 5A, the CNTs 16 were completely isolatedly dispersed and thus, no aggregate was observed. In contrast, a dispersion 28 used in Example 3, as shown in FIG. 6A, a plurality of aggregates 29 of the CNTs 16 were observed. However, not only in the composite fabric 10 according to Example 2 but also in the composite fabric 10 according to Example 3, substantially no aggregation portion was observed on the surfaces of the woven fabric 12A, and the CNTs 16 uniformly adhered to the surface of the carbon fiber 21. As a result, there was no difference between both Examples. From this fact, it was confirmed that use of the manufacturing method according to the present example caused the filter parts 22A to prevent the aggregates 29 of the CNTs 16 contained in the dispersion from adhering to the woven fabric 12A and it was possible to obtain the composite fabric 10 having a small number of aggregation portions even with a dispersion containing aggregates.

Figure 7C:
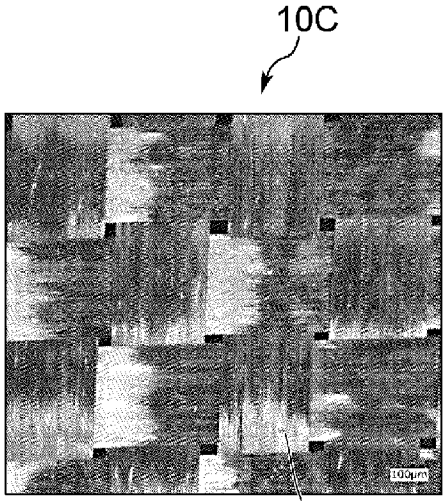
FIG. 7C is an enlarged view of a composite fabric according to Example 6.
Figure 7B:
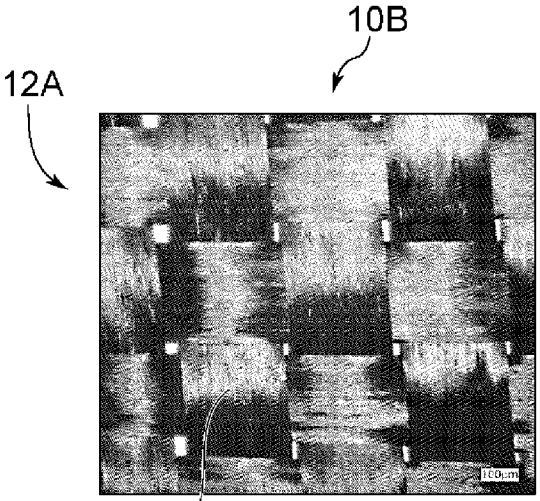
FIG. 7B is an enlarged view of a composite fabric according to Example 5.
Figure 7A:
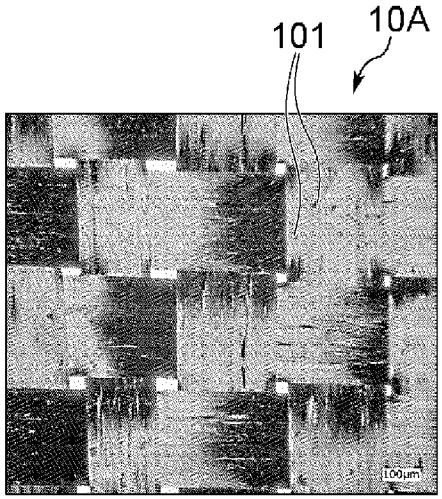
FIG. 7A is an enlarged view of a composite fabric according to Example 4.
Figure 7E:
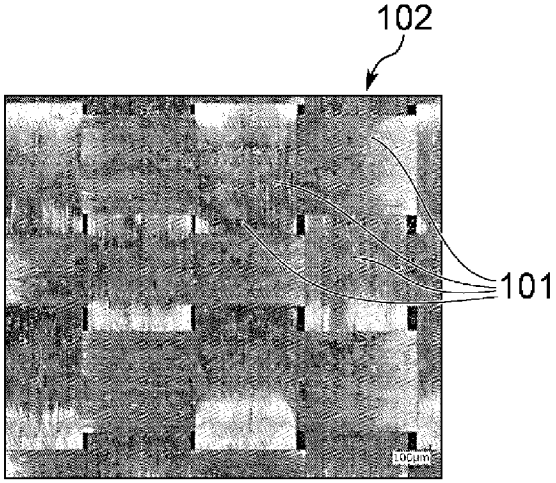
FIG. 7E is an enlarged view of a composite fabric according to Comparative Example 2.
Figure 7D:
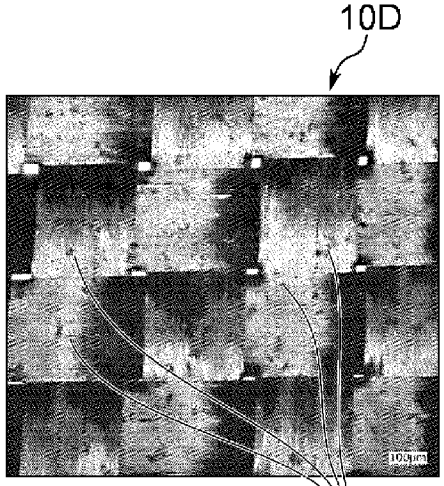
FIG. 7D is an enlarged view of a composite fabric according to Example 7.

Next, investigation was made on the relation between the opening size of the filter parts 22A and the amount of aggregation portions adhering to the surfaces of the composite fabric 10. A composite fabric 10 of each of Examples 4 to 7 was produced by replacing only the filter parts 22A in Example 1. As filter parts 22A in Example 4, mesh manufactured by NYTAL (model (product) number: NY10-HC, opening 10 μm) was used, as filter parts 22A in Example 5, mesh manufactured by NYTAL (model (product) number: NY20-HC, opening 20 μm) was used, as filter parts 22A in Example 6, mesh manufactured by NYTAL (model (product) number: NY41-HC, opening 41 μm) was used, and as filter parts 22A in Example 7, a net manufactured by Dio Chemicals, Ltd. (model number: Dio Crown Net, opening 840 μm) was used. A composite fabric 10 of Comparative Example 2 was produced under the same conditions as in Example 1 except that no filter part 22A and holding part 24 were used. The results are shown in FIGS. 7A to 7E. In Comparative Example 2, in which no filter part 22A was used, a large number of island-shaped aggregation portions 101 were observed (FIG. 7E). In contrast, as shown in FIG. 7D, it was confirmed that use of filter parts 22A having an opening of 840 μm provided small dot-shaped aggregation portions 101 in a smaller number. From this fact, it was confirmed that use of the filter parts 22A having an opening of 840 μm or less allows the composite fabric 10 having a small number of aggregation portions 101 to be manufactured.

(4) Modification Example

The present invention is not intended to be limited to the embodiment described above and can be modified within the spirit of the present invention.

Figure 8:
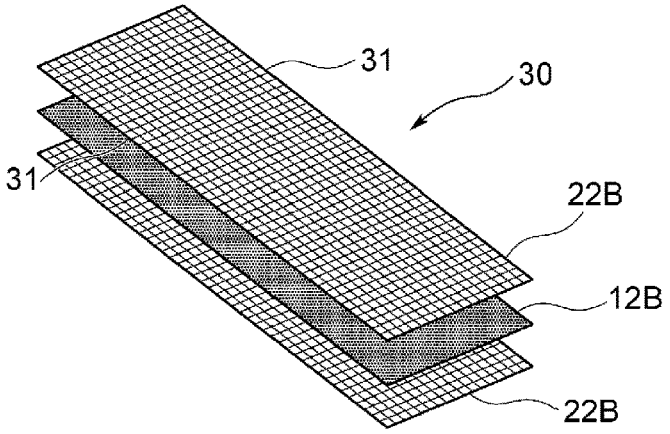
FIG. 8 is a perspective view (1) to be used for describing a method for manufacturing a composite fabric according to a modification example of the present embodiment.
Figure 9:
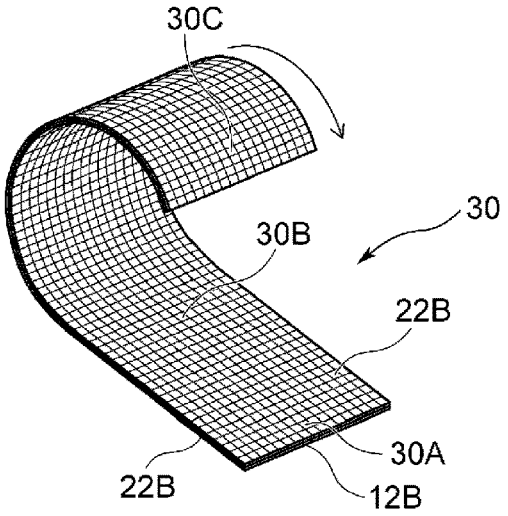
FIG. 9 is a perspective view (2) to be used for describing the method for manufacturing the composite fabric according to the modification example of the present embodiment.
Figure 10:
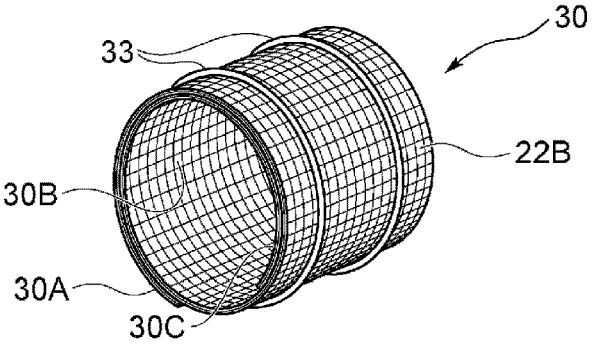
FIG. 10 is a perspective view (3) to be used for describing the method for manufacturing the composite fabric according to the modification example of the present embodiment.

In the embodiment described above, a laminate in which the woven fabric 12A, the filter parts 22A, and the holding parts 24 were integrated was used for manufacturing the composite fabric 10, but the present invention is not limited thereto. For example, as shown in FIG. 8, a laminate 30 is obtained by disposing a filter part 22B on both the sides of a woven fabric 12B in such a manner as to sandwich the woven fabric 12B. As shown in FIG. 9, toward one end 30A, the other end 30C of the laminate 30 is rolled up. The laminate 30 in a rolled-up state is held with rubber bands 33 (FIG. 10). Incidentally, edges (FIG. 8) 31 parallel to the longitudinal direction of the filter part 22A to be disposed inside may be each provided with a spacer (not shown). Such spacers, if provided, create clearance between rolled layers of the laminate 30, when rolled up in a roll, and allow the dispersion to penetrate easily between the rolled layers of the laminate 30. The spacers are preferably elastically deformable resin members and provided along the entire length of the filter part 22B.

Immersing the laminate 30 in this state in the dispersion and applying the dispersion to ultrasonic vibrations in the same manner as in the embodiment described above can provide the composite fabric 10 in which the structure 14 is formed on each surface of the woven fabric 12B. The aggregates of the CNTs 16 in the dispersion, which are blocked by the filter parts 22B, do not reach the woven fabric 12B, and thus, the effect same as that of the embodiment described above can be obtained.

Furthermore, in the case of the present Modification Example, holding the laminate 30 in a rolled-up state can provide clearance between the woven fabric 12B and the filter part 22B of 100 μm or less, and thus, the holding part 24 can be eliminated. In the present Modification Example, the case where the filter part 22B is disposed on both the sides of the woven fabric 12B has been described, but the present invention is not limited to this case. The filter part 22B which is disposed inside when the laminate 30 is rolled up in a roll may be eliminated.

In accordance with the manufacturing method according to the present Modification Example, the composite fabric 10 according to Example 8 was produced. The composite fabric 10 was produced under the same conditions as in above Example 1 except that a carbon fiber fabric (manufactured by SAKAI OVEX Co., Ltd., model (product) number: SA-32021, size 50×400 mm) was used as the woven fabric 12B and a net manufactured by Dio Chemicals, Ltd. (model number: Dio Crown Net, size 70×450 mm) was used as the filter part 22B. The laminate 30 was rolled up in a roll so as to have an outer diameter of 55 mm.

Figure 11B:
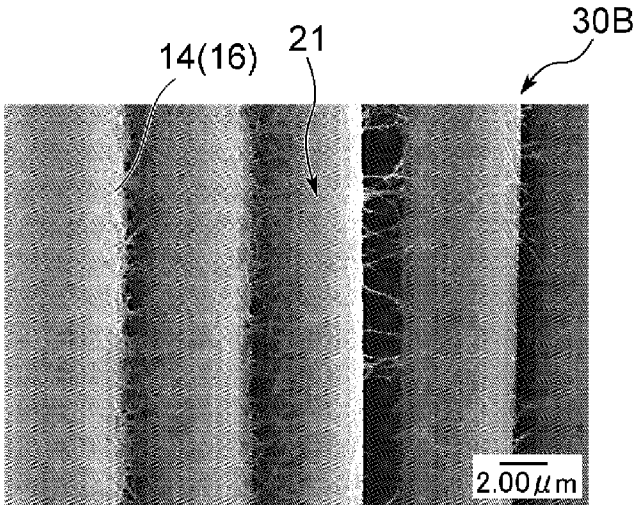
FIG. 11B is an SEM image of a carbon fiber bundle produced by the method for manufacturing a composite fabric according to the modification example, which image shows the center of the bundle, which is a portion including rolled layers of the laminate.
Figure 11A:
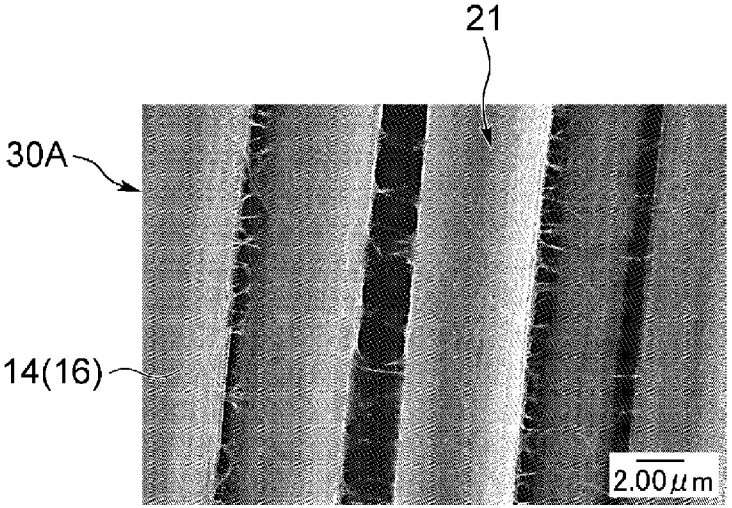
FIG. 11A is an SEM image of a carbon fiber bundle produced by the method for manufacturing a composite fabric according to the modification example, which image shows one end of the bundle, which is the outermost side of a laminate rolled up in a roll.
Figure 11C:
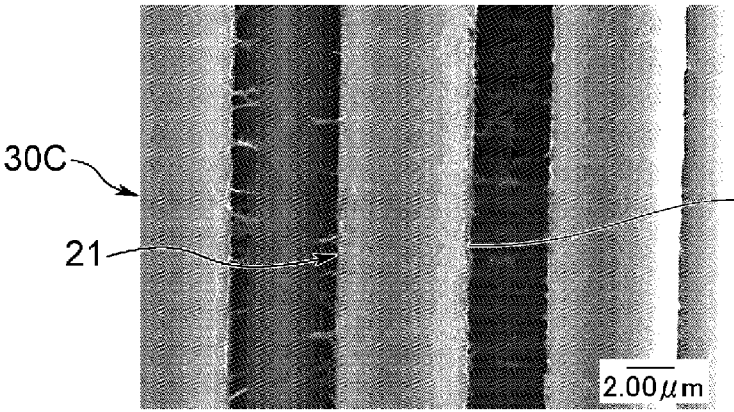
FIG. 11C is an SEM image of a carbon fiber bundle produced by the method for manufacturing a composite fabric according to the modification example, which image shows the other end of the bundle, which is the innermost side.

As a result, as shown in FIGS. 11A to 11C, at three points, that is, one end 30A, which is the outermost side of the laminate 30 rolled up in a roll, the center 30B, which is a portion including rolled layers of the laminate 30, and the other end 30C, which is the innermost side, the CNTs 16 adhered uniformly, and substantially no aggregation portion was observed. There was no difference in the form of the structure 14 across the entire composite fabric 10. Accordingly, it has been confirmed that the composite fabric 10 similar to that of the above embodiment can be produced also by the manufacturing method according to the present Modification Example.

REFERENCE SIGNS LIST

10 Composite fabric
12A, 12B Woven fabric
14 Structure
17 Carbon fiber bundle
18 Warp (weaving yarn)
20 Weft (weaving yarn)
22A, 22B Filter part
24 Holding part

The invention claimed is:

1. A method for manufacturing a composite fabric, the method comprising:

holding a surface of a filter part, through which a dispersion solvent and carbon nanotubes dispersed in the dispersion solvent are allowed to pass, in contact with at least one surface of a woven fabric comprising carbon fiber bundles as weaving yarn;

immersing the woven fabric on which the filter part is held in a dispersion that comprises the dispersion solvent and the carbon nanotubes dispersed in the dispersion solvent and applying ultrasonic vibrations to the dispersion; and extracting the woven fabric on which the filter part is held from the dispersion and removing the filter part from the woven fabric.

2. The method for manufacturing a composite fabric according to claim 1, wherein the filter part is provided on both sides of the woven fabric and held pressed against the woven fabric.

3. The method for manufacturing a composite fabric according to claim 2, wherein the filter part is held pressed against the woven fabric by a holding part whose surface protrudes curvedly in a thickness direction.

4. The method for manufacturing a composite fabric according to claim 1, wherein the filter part is held in a state where the woven fabric is wound in a roll shape such that the filter part faces an outside.

* * * * *